US005541475A

United States Patent [19]

Wood et al.

[11] Patent Number: 5,541,475

[45] Date of Patent: Jul. 30, 1996

[54] ELECTRODELESS LAMP WITH PROFILED WALL THICKNESS

[75] Inventors: Charles H. Wood; Philip A. Premysler, both of Rockville, Md.

[73] Assignee: Fusion Lighting, Inc., Rockville, Md.

[21] Appl. No.: 483,975

[22] Filed: Jun. 7, 1995

Related U.S. Application Data

[63] Continuation of Ser. No. 47,090, Apr. 16, 1993, abandoned.

[51] Int. Cl.[6] ..... H01J 61/00

[52] U.S. Cl. ..... 313/484; 313/634

[58] Field of Search ..... 315/248, 344; 313/483–489, 493, 634, 607–608

[56] References Cited

U.S. PATENT DOCUMENTS

| | | | |
|---|---|---|---|
| 3,761,757 | 9/1973 | Muhlbauer et al. | 313/110 |
| 4,359,668 | 11/1982 | Ury | 315/39 |
| 4,636,685 | 1/1987 | Skeist et al. | 313/493 |
| 4,652,790 | 3/1987 | Wood | 313/634 |
| 4,887,008 | 12/1989 | Wood | 313/634 |
| 5,013,966 | 5/1991 | Saikatsu et al. | 313/634 |
| 5,130,912 | 7/1992 | Friederichs et al. | 313/493 |

*Primary Examiner*—Stephen Brinich
*Attorney, Agent, or Firm*—Pollock, Vande Sande & Priddy

[57] ABSTRACT

An electrodeless discharge lamp has a thinner wall portion located proximate a position of high applied power. Since the heat capacity of the thinner wall portion is smaller then the remainder of the bulb wall, the thinner wall portion cools faster when the lamp power is turned off, and the condensable part of the fill tends to condense at this bulb wall portion. When the power is turned on again, since the thinner wall portion is located at a position of high power application, the fill is available in such region to be evaporated, thereby resulting in more rapid starting.

9 Claims, 2 Drawing Sheets

ELECTRODELESS LAMP WITH PROFILED WALL THICKNESS

This application is a continuation, of Ser. No. 08/047,090, filed on Apr. 16, 1993, now abandoned.

BACKGROUND OF THE INVENTION

This invention pertains to electrodeless discharge lamps.

Discharge lamps and particularly electrodeless discharge lamps which contain a condensable fill are known. When the lamp is not operating and cold, the condensable portion of the fill is condensed on the inside of the lamp envelope. These lamps usually also contain a gas which remains gaseous even at low temperatures. This gas facilitates starting as will be described below, and it may also serve the purpose of affecting the performance of the plasma by changing the thermal conductivity of the plasma.

Capacitively coupled, inductively coupled, and microwave excited varieties of electrodeless lamps are known. All of these lamp have in common that the power is supplied to the lamps, not through electrodes which penetrate the bulb, but rather by being subject to an externally produced electromagnetic oscillation. The variation of the pattern of the electromagnetic field, depends on the structure and operation of the external source of the electromagnetic field. Generally there are some areas of the bulb which are subject to higher electromagnetic field, at least during start up.

The starting process of discharge lamps with condensable fill and starting gas has several stages. At first the electromagnetic field is applied, then some minute ionization occurs in the bulb, perhaps by the incidence of a gamma ray from outer space, or as a result of photoelectrons being emitted from the envelope or condensed fill by the action of irradiation from an auxiliary source of ultraviolet light, or by some other agency. The electromagnetic field energizes the electrons and an avalanche breakdown occurs which leads to ionization of the whole starting gas (to some extent e.g. first or second ionization) to form a plasma therefrom. This initial plasma will be relatively low power density and may have a variation in intensity over the interior of the bulb that is different from that of the steady state plasma. The starting gas plasma heats the bulb envelope and thereby causes the evaporation of the condensable fill which is in turn ionized to partake of the discharge. As the condensable fill evaporates, the discharge becomes higher power until all the fill is vaporized and the power reaches its steady state value. The change in power absorbed by the bulb changes, because the impedance of the bulb changes as the condensable fill evaporates and the pressure in the bulb increases.

Upon turning off the power to the lamp, the condensable fill condenses in the area of the interior of the lamp which cools off fastest. This portion may be the area subject to the most forced external cooling e.g. under the cooling air jet, or the area which runs coolest at full power operation.

As discussed above, the starting gas plasma has some variation in intensity over the interior of the bulb. If the starting gas plasma is not very intense in the area of the bulb where the condensable fill condenses it takes a long time to evaporate the condensable fill and thus start the bulb. It may even be impossible, and even if it can be done the interval varies from one start up to the next, i.e., it is not repeatable.

Linear microwave electrodeless lamps made by the assignee of the instant invention direct cooling air and radiate microwave power toward the bulb from the same side. Thus, upon turning off the power, the fill condenses on the side of the bulb which receives power upon restarting the lamp.

SUMMARY OF THE INVENTION

According to the present invention, an electrodeless lamp envelope is provided with walls of reduced thickness at the area of the envelope wall where it is desired to condense the fill upon turning off the power. Such thinner wall portions by virtue of their higher thermal conductance between the inner and outer surfaces and their lower heat capacity (lower thermal mass) cool down faster.

According to another aspect of the invention, an electrodeless lamp subjects the lamp envelope to external forced cooling and the lamp envelope has thinner walls at the area of the envelope wall where it is desired to condense the fill upon turning off the power.

According to the preferred embodiment of the invention, a spherical electrodeless lamp envelope has a variation in wall thickness as a function of elevation angle i.e. from the equator to the poles, with a minimum in wall thickness at the equator. The same is subject to an electromagnetic field which is most intense near the equator, and to radially directed cooling air.

According to a second embodiment of the invention, an elongated envelope electrodeless lamp excited in a TM110 cavity which is supposed to subject the envelope to an relatively uniform field has a segment of its axial length which has a thinner wall positioned near a coupling slot of the cavity so as to receive strong direct radiation therefrom upon start up.

It is an object of this invention to provide an electrodeless lamp which starts quickly and assuredly.

BRIEF DESCRIPTION OF THE DRAWINGS

The invention will be better understood by referring to the accompanying drawings, wherein.

BRIEF DESCRIPTION OF THE PREFERRED EMBODIMENT

Figure 1:
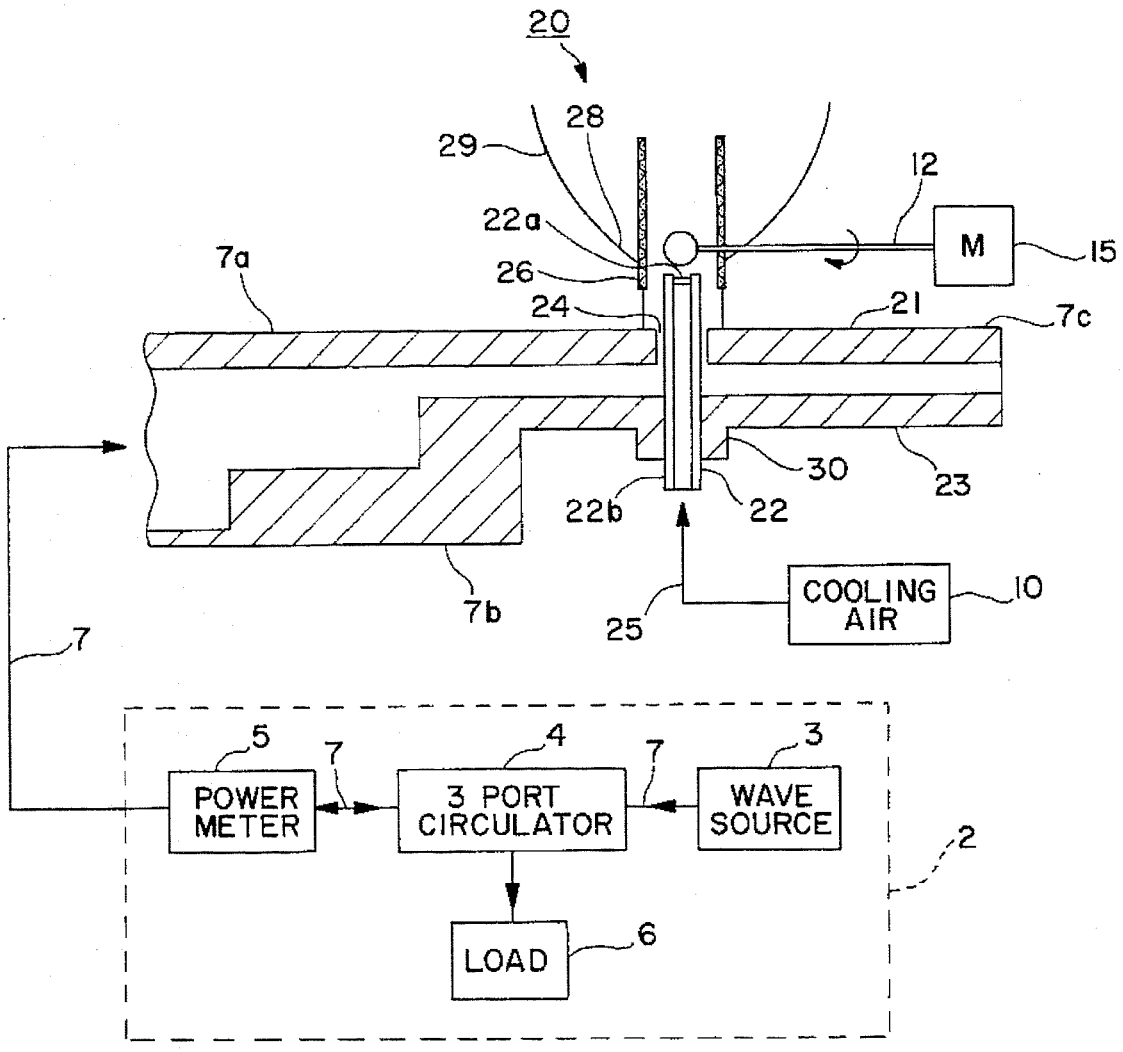
FIG. 1 is a schematic illustration of an experimental set up.

Referring to FIG. 1, the preferred embodiment of the invention will be described. The lamp fixture generally designated by 20 is fed power from an experimental set up power system generally designated by reference numeral 2.

The power system is configured as follows. A microwave or radio frequency (r.f.) source 3 generates power, which is preferably from about 500 to about 10,000 watts per cubic centimeter of bulb volume. The frequency may range from high frequencies upwards of 3 gigahertz to low frequencies below 100 kilohertz, sufficient fields being attainable with sources of sufficient strength, which sufficiency can easily be determined by experiment.

The source 3 is coupled to a three port circulator 4 which isolates the source 3 from non-absorbed power that is reflected from the fixture 20. The circulator is connected to a power meter 5 which measures forward and reflected power and a dissipative load 6 which absorbs reflected power. Power flows through the power meter 5 to the section of waveguide 7*a* which is connected to fixture 1. All connection lines designated by reference numerals 7, 7*a* represent rectangular waveguide. The dissapitive load 6 is connected directly to the circulator 4. In a finalized production design, the power system 2 may be considerably simplified by eliminating the power meter 5, circulator 4, and dissipative load 6 once the design is fixed and finally tuned.

The waveguide section 7*a* is connected to a stepped section 7*b* which comprises two steps in the height of the waveguide connected to low height section of waveguide 7*c*. The steps serve as an impedance transformer to partially match the impedance of the waveguide 7, 7*a* to that of the fixture 20 which is mounted on the top broadside 21 of the low height waveguide section 7*c*. The inner conductor 22 is mounted on the lower broad wall 23 of the reduced height waveguide section 7*c*, and extends upwards through a hole 24 in the upper broad wall 21. The inner conductor is fixed by set screw 30. The hole in the upper broad wall 21 is large enough to provide insulating gap clearance. The bulb is preferably located very close to the end 22*a* of the inner conductor for good coupling. In the embodiment shown, the top of the inner conductor 22 has a recess. Cooling air is fed from source 18 through line 19 to the bottom of the inner conductor 22 at the lower broad wall 23, through a bore 22*b* up the length of the inner conductor 22*b* to one or more cooling air jet orifices in the base of recess 22*a* and is jetted against the bulb 12. Preferably the cooling holes (not shown) comprise two holes of 0.9 mm arranged along the equator of the bulb and two holes of 0.5 mm arranged near the poles of the bulb. All the holes are arranged on a circle 3.0 mm diameter centered below the bulb. The outer conductor comprises an open cylindrical wall 26 connected to the upper broad wall 21 It is taller than the inner conductor. Although in the experimental model, even with top of the outer conductor 26 open there is little leakage, the top may be capped with a suitably shaped end piece such as a flat piece or a spherical piece. The cylindrical wall 26 being foraminous can serve as the outer conductor while at the same time being substantially transparent to the radiation of the lamp. Located around the bulb outside the outer conductor 26 is a metal reflector 29. The inner conductor 22 and the outer conductor 26 form a coaxial excitation structure, which produces high strength electromagnetic fields necessary for coupling to small high power electrodeless discharge lamps.

The stem of the bulb 12 extends through a hole in the mesh 27 and a hole in the reflector 29, and is mechanically coupled to a motor 15, which serves to rotate the bulb about an axis through its stem during operation which prevents arc attachment in the bulb. The bulb rotation axis is arranged so that parts of the bulb which come near the high field intensity region near the end 22*a* of the inner conductor do not remain there but are constantly rotated around. The rotation axis is arranged with respect to said inner conductor at an angle ranging from 30 to 150 degrees, preferably between 45 and 135 degrees. The rotation axis may be arranged perpendicular, as shown. Additional information on rotation is discussed in co-pending application Ser. No. 976,938 filed Nov. 18, 1992.

Figure 2:
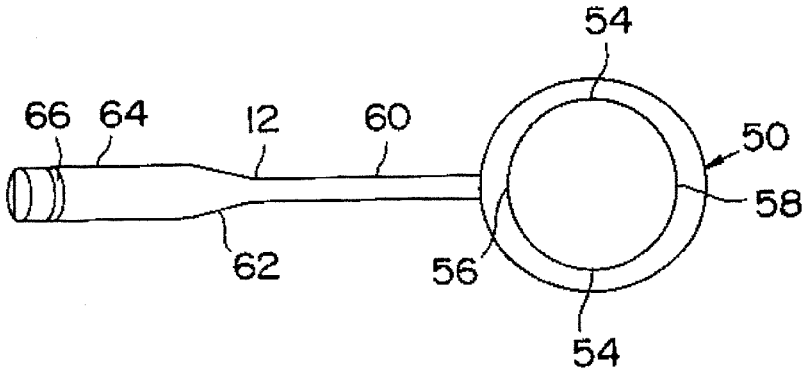
FIG. 2 is a cross-sectional view of the lamp according to the preferred embodiment of the invention.

Referring to FIG. 2, a cross-sectional view of the lamp bulb is shown. The bulb comprises a discharge envelope 50 and a stem 12, which lies along the polar axis of the bulb. The inside wall surface of the envelope is about 5 mm average diameter. In a 60 degree band 54, 30 degrees above the equator and 30 degrees below, the bulb wall thickness is maintained at 0.5 mm within a tolerance of ±0.05 mm. The equator is taken with respect to the axis of the stem 12 as being the polar axis. The wall thickness at the poles 56 and 58 is maintained at 0.6 mm within the same tolerance. The wall thickness between the 60 degree equatorial band 54 and the poles gradually tapers between the two specified thicknesses.

When the power is turned off, the fill condenses on the thinner wall equatorial band 54.

The stem includes a 1.5 mm diameter section 60 which extends about 23 mm from the bulb. A tapered section 62 connected thereto about 5 mm in length and a final section 64, 4 mm in diameter, and about 25 mm in length. The final section is secured to the motor 15. The final section includes a groove 66 for securing the bulb to a motor shaft (not shown) of motor 15 and chamfered section 68 which facilitates assembly of the bulb and motor. The chamfered section and groove are disclosed in U.S. Pat. No. 4,947,080 assigned in common with the instant invention.

According to the invention, the bulb fill comprises a condensable material in quantities relative to its vapor pressure such that a portion of the material will be condensed when the lamp is cold. By way of non-limitative example, the fill may comprise fills including but not limited to mercury with or without metal halide additives or metal oxyhalides, or sulfur containing fills. The fill may also comprise a material which is gaseous when the lamp is cold, including but not limited to neon, argon, krypton, or xenon or mixtures thereof. Such a gas may be included in amounts ranging from less than 1 to several hundreds of torr, preferably 1 to 1000 torr (measured at room temperature), more typically from about 20 to about 200 torr. In the preferred embodiment of the invention, the fill is a sulfur containing fill. By way of non-limitative example, the fill may be comprised of elemental sulfur or sulfur compounds including InS, $As_2S_3$, $S_2Cl_2$, $Cs_2$, $In_2S_3$ or SeS. Fills comprising these and/or similar substances are taught in co-pending U.S. patent applications Ser. No. 604,487 filed Nov. 25, 1990, now U.S. Pat. No. 404,076; assigned in common with the instant inventions and incorporated herein by reference. The amount of the fill is such that it is present at a pressure of at least about 1 atmosphere and preferably 2 to 20 atmospheres at operating temperature when the fill is excited, and it is excited at a relatively high power density. For example, the power density of microwave energy, which may be used as the excitation source, would be at least 50 watts/cc and preferably greater than 100 watts/cc. For example, the bulb shown and described in connection with FIGS. 1 and 2 may contain about 0.3 mg of sulfur and 150 torr of argon. The bulb is made of quartz or other suitable material.

During the starting gas discharge phase of operation, as described in the background section, the discharge is concentrated near the equator and on the side of the equator near the end of the inner coaxial conductor. When the excitation energy is turned off the condensable fill condenses on equatorial band 54 of the discharge bulb envelope. Upon starting the lamp, the condensable fill condensed on the equatorial band is quickly evaporated by the heating action of the starting gas discharge which occurs near the equator.

Figure 3:
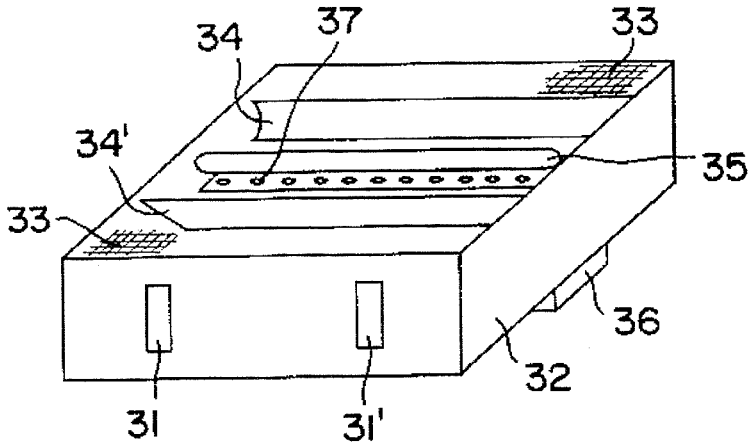
FIG. 3 is a schematic illustration of a second embodiment of the invention.

Referring to FIG. 3, a second embodiment of the invention is shown. The cavity shown in this Figure is disclosed in co-pending U.S. patent application Ser. No. 07/849,719 assigned in common with the instant invention. Microwave power is coupled through a pair of coupling slots 31, 31' from waveguides (not shown) into a hexahedron cavity 32 and supports a TM110 mode electromagnetic mode therein. There is also a component of the electromagnetic field which is not accounted for by the TM110 mode but is in the form of a radiation from the slots 31, 31'. The entire top of the cavity 32 is a screen 33 which allows light to exit the cavity. Inside the cavity are located a pair of interference reflector coated dielectric half reflectors 34, 34'. An elongated electrodeless discharge bulb 35 is located between the reflector halves 34, 34'. The discharge fill may comprise a fill of mercury, metal halide additives, and starting gas, a wide range of such fills being well known in the art. Cooling air is supplied by cooling air plenum through cooling air holes 37 to the bulb 35. Cooling holes 37 are in the bottom of the cavity and air is directed upwardly towards the bulb. The cooling is uniform over the length of the bulb.

Figure 4:
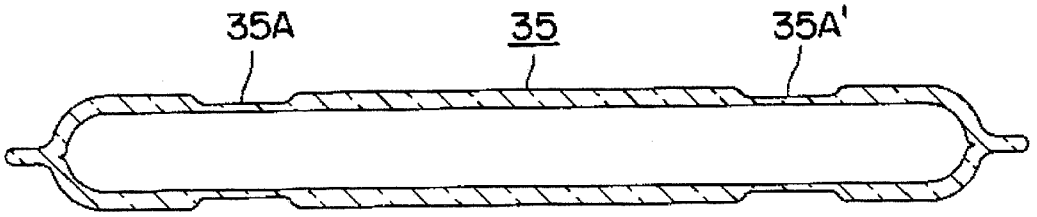
FIG. 4 is a detailed cross-sectional view of the bulb according to the second embodiment of the invention.

Referring to FIG. 4, a detailed cross-sectional view of the elongated discharge bulb, 35 is shown. The discharge bulb has two sections of reduced wall thickness 35A, 35A'. These two sections are located closest to coupling slots 31, 31' in the installed position.

When the power is turned off, the fill will condense at the sections of reduced wall thickness 35A, 35A'. Since these sections are near the coupling slots, they will be subject to high strength electromagnetic fields upon powering up the lamp and thereby starting will be facilitated.

It should be appreciated that while the invention has been disclosed in connection with illustrative embodiments, variations will occur to those skilled in the art, and the scope of the invention is to be limited only by the claims appended hereto as well as equivalents.

We claim:

1. An electrodeless lamp comprising, a bulb having a bulb wall of quartz which encloses a fill which includes a fill portion which is condensable when power to the lamp is turned off, means external to said bulb for coupling microwave or r.f. power thereto when the lamp is turned on in such manner that said power is distributed, at least during a lamp starting phase, in said bulb so as to be higher in a particular region or regions, wherein said bulb wall is of reduced thickness in said particular region or regions.

2. The electrodeless lamp of claim 1, wherein said fill also includes a starting gas, which forms a discharge during said lamp starting phase.

3. The electrodeless lamp of claim 1 wherein said bulb is substantially spherical in shape, said means external to said bulb for coupling comprises coaxial excitation means having outer and inner conductors, and the bulb wall is of reduced thickness in a region which lies near said inner conductor during lamp operation.

4. The electrodeless lamp of claim 3 wherein the region of reduced thickness is an equatorial region, further comprising means for rotating the bulb about an axis through its poles.

5. The electrodeless lamp of claim 1 wherein said fill comprises a sulfur containing fill.

6. The electrodeless lamp of claim 4 wherein said fill comprises a sulfur containing fill.

7. The electrodeless lamp of claim 1 further characterized in that, said means for coupling comprises a TM110 hexahedron cavity, provided with one or more coupling slots, and said bulb is tubular in shape, and has a bulb wall of reduced thickness at a region or respective regions which are located near said coupling slot or respective slots.

8. The electrodeless lamp of claim 1 wherein said means for coupling microwave or r.f. power is closer to said particular region or regions of said bulb then to the remainder of said bulb.

9. The electrodeless lamp of claim 8 wherein said particular region or regions of said bulb wall cool down more quickly than the remainder of the bulb wall when said power is turned off.

* * * * *